US006158306A

United States Patent [19]

Gasparre

[11] Patent Number: 6,158,306

[45] Date of Patent: Dec. 12, 2000

[54] JAR HOLDER

[76] Inventor: Pasquale Gasparre, 12 Alice St., E. Patchogue, N.Y. 11772

[21] Appl. No.: 09/167,440

[22] Filed: Oct. 6, 1998

[51] Int. Cl.[7] ..... B67B 7/46

[52] U.S. Cl. ..... 81/3.32; 81/3.43

[58] Field of Search ..... 81/3.31, 3.32, 81/3.36, 3.39, 3.43, 64; 269/131

[56] References Cited

U.S. PATENT DOCUMENTS

| | | | |
|---|---|---|---|
| 152,940 | 7/1874 | Bean | 81/3.32 |
| D. 249,323 | 9/1978 | Hutson . | |
| D. 249,324 | 9/1978 | Hutson . | |
| D. 254,647 | 4/1980 | Olsson . | |
| D. 257,318 | 10/1980 | Zorzi . | |
| D. 258,192 | 2/1981 | Maloney . | |
| D. 296,293 | 6/1988 | Wheeler . | |
| D. 303,343 | 9/1989 | Nuss . | |
| D. 333,958 | 3/1993 | Demers . | |
| D. 351,970 | 11/1994 | Barrio . | |
| 908,450 | 1/1909 | Denny | 81/3.32 |
| 1,292,933 | 1/1919 | Wagner | 81/3.32 |
| 1,353,058 | 9/1920 | Mersman | 81/3.32 |
| 1,929,334 | 10/1933 | Sabatine | 81/3.32 |
| 2,215,016 | 9/1940 | Sammons | 81/3.32 |
| 2,394,323 | 2/1946 | Menke | 81/3.32 |
| 3,728,916 | 4/1973 | Brantley | 81/64 |
| 3,950,801 | 4/1976 | Morrison . | |
| 3,999,261 | 12/1976 | Bingaman . | |
| 4,107,791 | 8/1978 | Mikituk . | |
| 4,165,115 | 8/1979 | Olsson . | |
| 4,306,470 | 12/1981 | Woloszyn . | |
| 4,491,040 | 1/1985 | Corona | 81/3.32 |
| 4,766,781 | 8/1988 | Grise et al. . | |
| 5,097,729 | 3/1992 | Brown . | |
| 5,313,857 | 5/1994 | Weisband | 81/3.31 |
| 5,365,806 | 11/1994 | Paramest . | |
| 5,401,011 | 3/1995 | Gatenby et al. | 269/131 |
| 5,617,765 | 4/1997 | Bennett . | |
| 5,647,251 | 7/1997 | Hardman . | |
| 5,704,258 | 1/1998 | LaVoie | 81/3.43 |

*Primary Examiner*—David A. Scherbel
*Assistant Examiner*—Joni B. Danganan
*Attorney, Agent, or Firm*—Alfred M. Walker

[57] ABSTRACT

A flexible mounted jar holder tightly holds a jar upon a flat base while a user loosens a tightened cap therefrom. The jar holder includes a resilient, ribbed gripping first retaining strap which encircles and locks the jar in place therebetween. A locking member includes a pair of upwardly extending fixed posts, and a third locking cam post, which includes an ellipsoid cross sectional diameter. A further retaining means includes at least one further flexible strap which is urged against a portion of the outer circumference of the jar to be held at a point opposite to where the first retaining strap is urged against the outer circumference of the jar to be held. This further flexible retaining strap is stretched linearly between the pair of fixed posts. Preferably the further flexible retaining strap includes a pair of further retaining straps having respective looped ends insertable over each respective fixed post. The first retaining strap includes a looped proximal end portion engagable over one post of the pair of fixed posts. At a distal end of the first retaining strap is a distal locking end portion lockable between one of the fixed posts and the movable cam post.

12 Claims, 3 Drawing Sheets

FIG.1
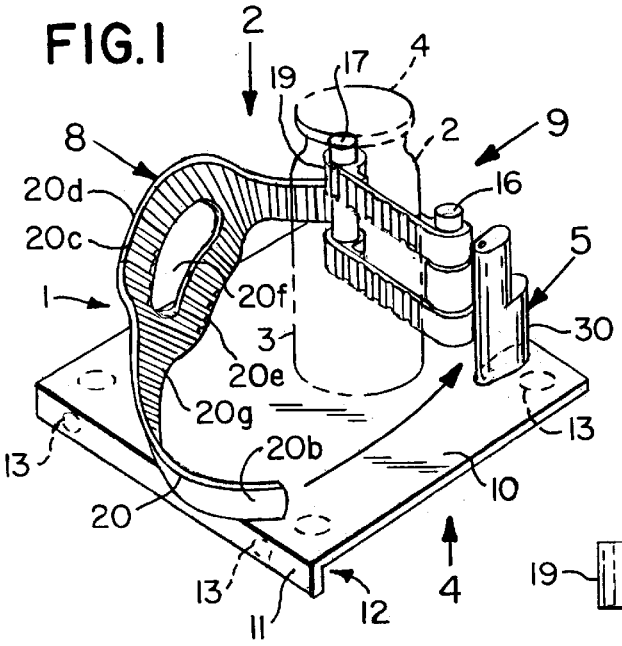
FIG.2
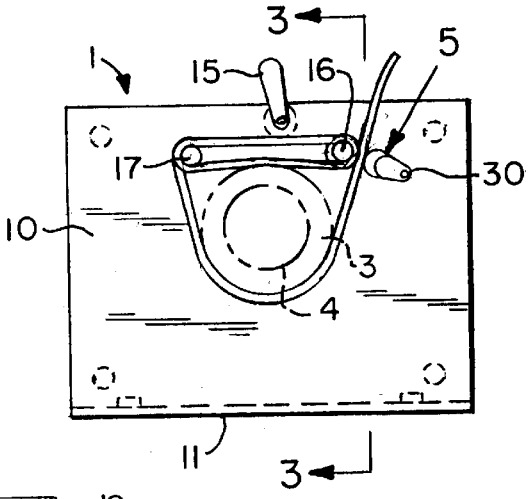
FIG.3
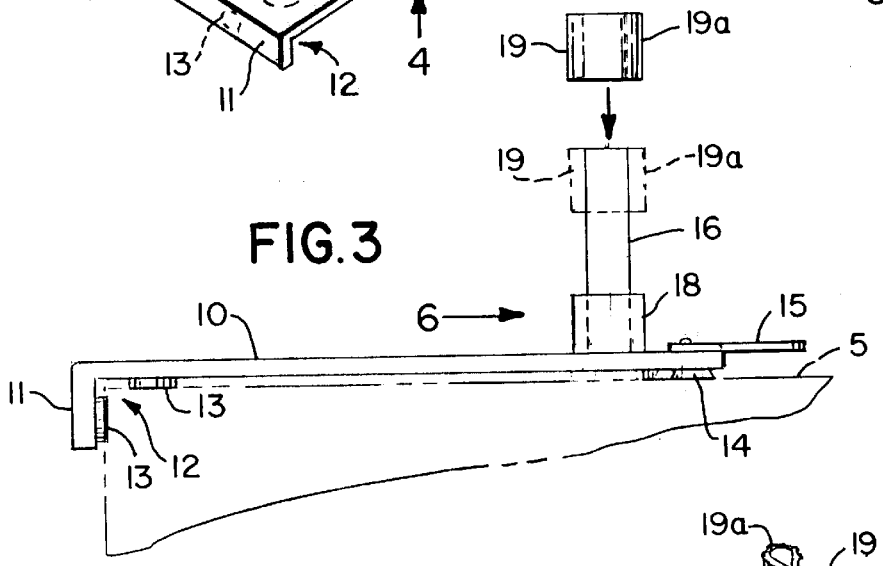
FIG.5
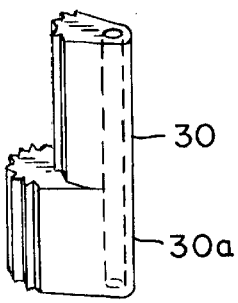
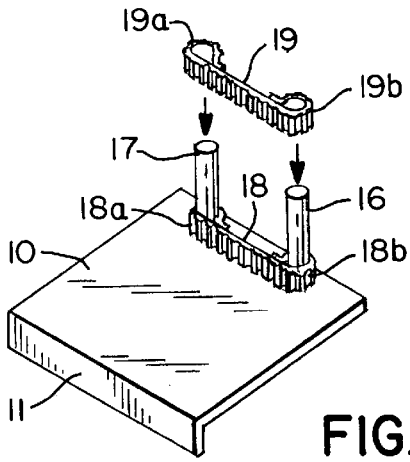
FIG.3A FIG.3B
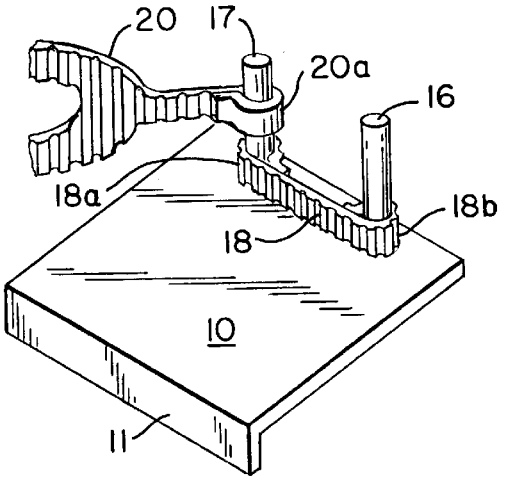
FIG.4
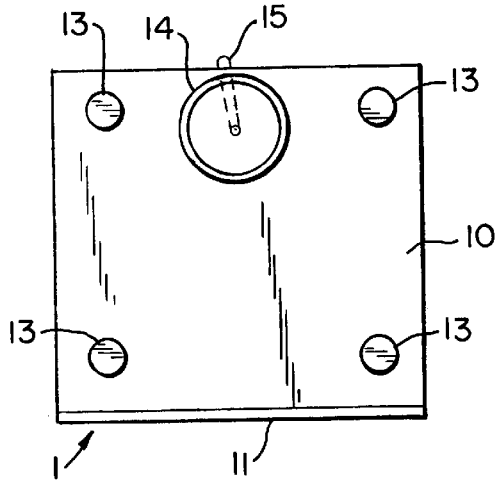
FIG.6
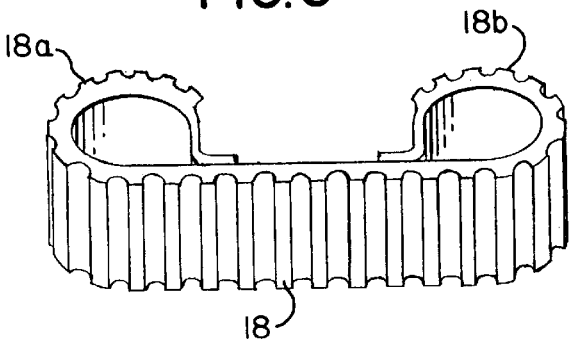
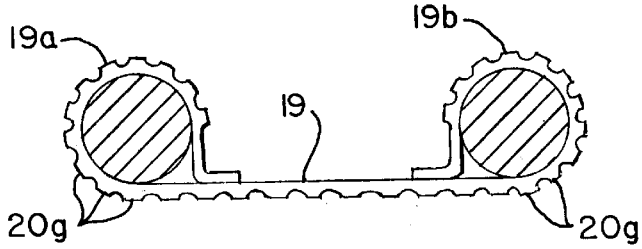
FIG.6A FIG. 7
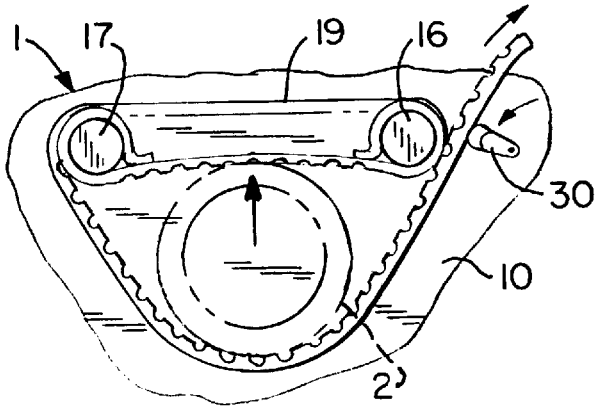
FIG. 8
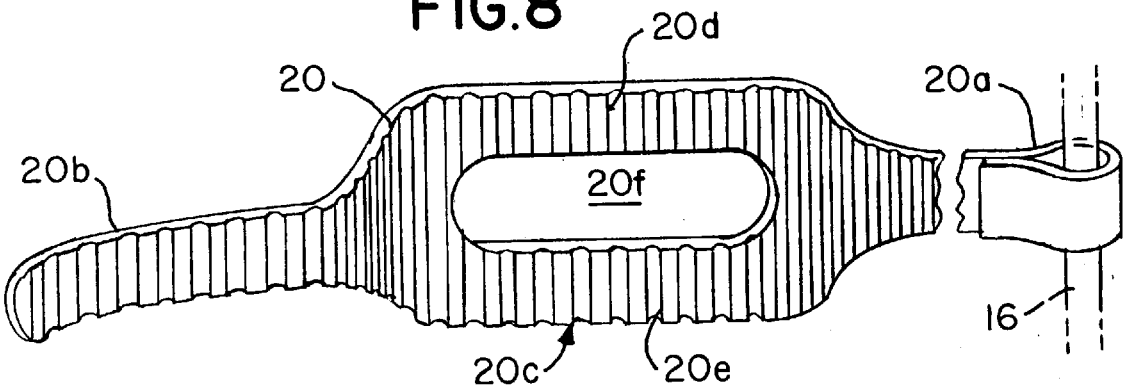
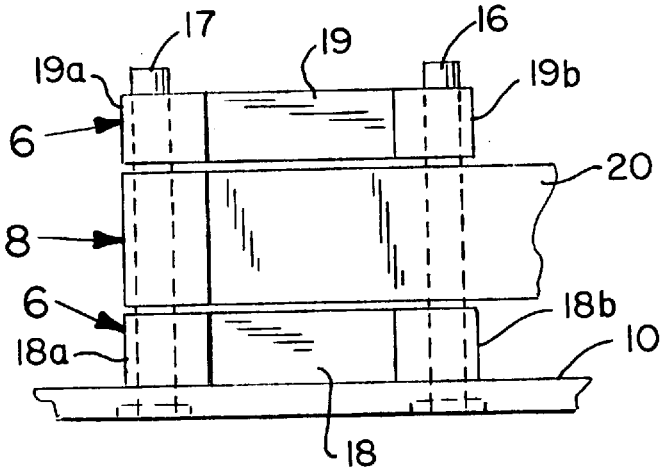
FIG. 9

JAR HOLDER

FIELD OF THE INVENTION

The present invention relates to holders for holding jars while loosening tight caps therefrom.

BACKGROUND OF THE INVENTION

Opening a jar with a tight cap is often tedious, especially for persons with limited manual strength, such as persons with arthritis, carpal tunnel syndrome and the like. Therefore, various attempts have been made to provide a retaining holder for a jar during the opening thereof, such as the pad-type jar gripper as described in U.S. Pat. No. 3,999,361 of Bingaman. However, the resilient compressible angular array of upwardly extending fingers of Bingaman '361 cannot be adjusted for jars of varying diameters.

Other jar holders include wedge shaped retaining walls, wherein the cap of the jar is inserted in a wide open portion until the diameter of the cap is gripped by the retaining members, at a point where the opening between the corresponding parts of the retaining walls, such as described in U.S. Pat. No. Des. 258,192 of Maloney, U.S. Pat. No. Des. 296,293 of Wheeler, U.S. Pat. No. Des. 333,958 of Wheeler, and U.S. Pat. No. Des. 257,318 of Zorzi.

Similarly, U.S. Pat. No. 5,097,729 of Brown includes a wedge shaped pair of gripping handles having a gripping band tightenable around a cap to be removed. However, these openers grip the cap only, and do not hold the jar to which the cap is attached, which further reveals the need for a jar gripper, as opposed to a cap gripper. The user still has to grip the jar of a generally wider diameter, which is a problem for persons with limited gripping powers.

Other screw cap removers are described in U.S. Pat. No. 4,306,470 of Woloszyn, which includes a lockable cam urging jaw members about a jar cap to be loosened, U.S. Pat. No. 4,165,115 of Olsson, U.S. Pat. No. Des. 265,647 also of Olssen, U.S. Pat. No. 3,950,801 of Morrison, U.S. Pat. No. Des. 351,970 of Barrio, U.S. Pat. No. 5,617,765 of Bennett, which includes worm gears moving gripping surfaces against a lid, U.S. Pat. No. 5,365,806 of Panemest, U.S. Pat. No. 5,647,251 of Hardman, U.S. Pat. No. Des. 303,343 of Nuss, U.S. Pat. No. 4,766,781 of Grise, which includes a lid engaging funnel with a gripping insert therein, U.S. Pat. No. Des. 249,323 of Hutson and U.S. Pat. No. Des. 249,324 also of Hutson. Moreover, U.S. Pat. No. 4,107,741 of Mikituk describes a locking system for tightening a blending jar of a blender in place for performing a blending operation.

OBJECTS OF THE INVENTION

It is therefore an object of this invention to provide a jar holder which firmly holds a jar, rather than a cap of a jar, for loosening the cap from the jar.

It is another object of this invention to provide a jar holder which frees the hands of a user during the jar opening task.

It is a further object of this invention to provide an adjustably sized jar holder that can hold jars of various sizes while dislodging the cap from the jar.

It is also an object of the present invention to improve over the disadvantages of the prior art.

SUMMARY OF THE INVENTION

In keeping with these objects and others which may become apparent, the present invention includes a flexible mounted jar holder which operates by resiliently and tightly holding a jar upon a flat base while loosening a cap therefrom.

The jar holder includes a resilient, ribbed gripping first retaining strap which locks the jar in place. A locking member includes at least one fixed post, such as a pair of upwardly extending fixed posts, and a third rotatable cam post, which includes an ellipsoid cross sectional diameter.

When the retaining strap is wrapped around an outside circumference of the jar, it is then inserted between one of the upwardly extending fixed posts and the rotatable locking cam post. Pulling the distal leading edge of the retaining strap therebetween causes the cam post to be rotated into place, and locks the retaining strap between the fixed post and the cam post.

A preferred embodiment includes a further retaining means which includes at least one further flexible strap, such as a strip, which is urged against a portion of the outer circumference of the jar to be held, at a point opposite to where the first retaining strap is urged against the outer circumference of the jar to be held. This at least one further flexible retaining strap, such as a strip, is stretched linearly between the pair of fixed posts. Preferably the at least one further flexible retaining strap includes a pair of further retaining straps, such as strips, each having respective looped ends insertable over each respective fixed post. The pair of further retaining straps therefore includes a further lower retaining strap below the jar engaging position of the first retaining strap. The further upper retaining strap extends thereabove.

The first retaining strap also includes a looped proximal end portion engagable over one post of the pair of fixed posts.

As noted above, at a distal end of the first retaining strap there is provided the locking end portion, which is lockable between one of the fixed posts and the movable cam post.

At a mid portion of the first retaining strap is preferably provided a wider jar engaging portion, which includes preferably a pair of parallel strips separated by a gap, to adapt to changing diameters of upper and lower portions of the jar to be opened, or to be able to grip both short or tall jars. This main retaining strap is wrapped around the jar and locked in place by the turning of the cam post until tightened by the movement of the retaining strap between the fixed post and the rotatable cam post.

BRIEF DESCRIPTION OF THE DRAWINGS

The present invention can best be understood in connection with the accompanying drawings in which:

FIG. 1 is a diagrammatic perspective view of the jar holder of the present invention;

FIG. 2 is a diagrammatic top plan view taken along arrow "2" of FIG. 1;

FIG. 3 is an enlarged sectional view taken along line "3—3" of FIG. 2;

FIG. 3A is a diagrammatic perspective view of FIG. 3;

FIG. 3B is a diagrammatic perspective view of an alternate embodiment for a jar holder of the present invention;

FIG. 4 is a bottom plan view taken along arrow "4" of FIG. 1;

FIG. 5 is an enlarged perspective view, taken along arrow "5" of FIG. 1, of the locking means;

FIG. 6 is an enlarged perspective view, taken along arrow "6" of FIG. 3, of a typical retaining strap;

FIG. 6A is a top plan view thereof;

FIG. 7 is an enlarged diagrammatic partial top plan view, of the present invention, illustrating the holding means in application;

FIG. 8 is an enlarged diagrammatic view, taken along arrow "8" of FIG. 1, illustrating the main locking strap; and, FIG. 9 is an enlarged rear elevational view taken along arrow "9" of FIG. 1, illustrating the positioning of each strap.

LIST OF REFERENCE NUMERALS

| | |
|---|---|
| 1 | jar holder device in general |
| 2 | jar |
| 3 | outside girth of jar 2 |
| 4 | jar cap |
| 5 | tabletop surface |
| 10 | base of jar holder 1 |
| 11 | downwardly extending shoulder of base 10 |
| 12 | right angle corner between base 10 and shoulder 11 |
| 13 | friction pads under base 10 |
| 14 | suction cup |
| 15 | lever for suction cup 14 |
| 16, 17 | fixed posts of jar holder 1 above base 10 |
| 18, 19 | looped straps between posts 16, 17 (18 on bottom, 19 on top) |
| 18a, 18b | loops for looped strip 18 |
| 19a, 19b | loops for looped strip 19 |
| 20 | main retaining strap |
| 20a | looped proximal end of retaining strap 20 |
| 20b | distal locking end of retaining strap 20 |
| 20c | mid-jar engaging portion of retaining strap |
| 20d | upper mid-jar engaging belt portion of retaining strap 20 |
| 20e | lower mid-jar engaging belt portion of retaining strap 20 |
| 20f | gap between jar engaging belt portions 20d, 20e |
| 20g | ribs on surface of looped straps 18, 19 |
| 30 | cam post |
| 30a | wider ellipsoid bottom portion of cam post 30 |

DETAILED DESCRIPTION OF THE INVENTION

The following description of the drawings is merely illustrative of one embodiment, and is not meant to be limiting the scope of the invention.

FIGS. 1–3A show jar holder 1 for holding jar 2 having exterior circumferential girth 3 and tightened screwable cap 4 thereupon. Jar 2 is fixed in place by first retaining strap 20. Jar holder 1 includes flat base 10 upon which jar 2 sits while being held in place for manually opening cap 4 therefrom.

Base 10 preferably includes downwardly extending shoulder 11 providing a right angle corner 12 therebetween, for holding base 10 firmly against the edge of a surface 5 of a tabletop or countertop. Friction inducing pads 13, such as of foam rubber or other natural or synthetic compressible material, may be placed underneath base 10, between base 10 and the tabletop or countertop. To retain base 10 firmly in place without movement, fastener 14, such as a suction cup releasable by pivotable lever 15, is provided between base 10 and surface 5. Base 10 also includes at least one fixed post 16, preferably a pair of fixed posts 16, 17, extending upwardly from base 10.

To engage a portion of circumferential girth 3 of jar 2, at least one flexible but taunt strip 18, such as a pair of taunt strips 18, 19, extends between fixed posts 16, 17. When a pair of strips 18, 19 is used, one strip 18 extends below a proximal portion 20*a* of retaining strap 20. Each strip 18, 19 includes respective pairs of post-engaging loops 18*a*, 18*b* or 19*a*, 19*b*. Loops 18*a*, 18*b* are slid over respective posts 16, 17, and looped proximal end 20*a* of retaining strap 20 is slid over a fixed post, such as fixed post 16, above looped end 18*b* of strip 18. Afterwards, distal lockable end 20*b* is wrapped around the circumferential girth 3 of jar 2 and then slid between fixed post 16 and rotatable cam post 30, which includes ellipsoid portion 30*a*, having a wider diameter in one direction, cam post 30 is alternatively pivotable against distal end 20*b* of retaining strap 20, squeezing and locking distal locking end 20*b* of retaining strap 20 between cam post 30 and fixed post 16. When pivoted in an opposite direction, the wider part of cam post 30 is released from against distal locking end 20*b* of retaining strap 20.

Retaining strap 20 further includes a mid jar engaging portion 20*c*, which extends between proximal looped end 20*a* and distal locking end 20*b*. Preferably, as shown in FIG. 9, mid jar engaging portion 20*c* includes upper portion 20*d* and lower portion 20*e*, both separated by recess gap 20*f*. In that manner if jar 2 is bottled necked, with an upper neck having a smaller diameter than a wider lower portion, the differences in circumference between the upper and lower portions of the jar can be compensated for when bottle engaging portions 20*e*, 20*d* are urged against jar 2. Having two bottle engaging portions 20*d* and 20*e* also allows both short and tall jars to be held in place, since lower portion 20*e* can accommodate single short jars, but both upper and lower portions 20*d*, 20*e* together can hold a tall jar in place.

Therefore, in a preferred embodiment shown in FIGS. 1–9, jar 2 is squeezed between strips 18, 19 on one side and retaining strap 20 on the other side, as shown from above in the top plan view of FIG. 2.

The vertical arrow provided in FIG. 3, shows the slidable direction of looped ends 18*a*, 19*a* of strips 18, 19 upon fixed post 16. As shown in FIG. 6A, preferably strips 18, 19 include jar engaging members 20*g*, *such as flexible protrusions.*

FIGS. 5 and 7 show cam post 30 having wider portion 30*a*, which when cam post 30 is pivoted, squeezes distal end 20*b* of first retaining strap 20 between fixed post 16 and cam post 30.

When held in place, jar 2 is securely locked in place and is ready for removal of cap 4 therefrom by manual twisting of cap 4 in the approximate loosening direction.

Moreover, FIG. 3B shows an alternate embodiment wherein post engaging loop 20*a* of retaining strap 20 is placed over post 17, instead of post 16, above loop 18*a* of strip 18, instead of above loop 18*b* on post 16. Retaining strip 20 then extends around side and front portions of jar 3, and is inserted and locked in place between post 16 and cam post 30 extending up from base 10 with shoulder 11.

FIG. 3B does not show upper strip 19, which is normally placed above retaining strap 20. As noted before, upper strip 19 is held in place by the placement of respective looped ends 19*a* and 19*b* over respective posts 17 and 16, as shown in FIGS. 1, 3A and 9.

It is further noted that other modifications may be made to the present invention without departing from the scope of the invention, as noted in the appended claims.

I claim:

1. A jar holder for holding a jar during loosening of a cap therefrom, comprising:

a base, upon which said base sits a jar to be opened, said base having at least one upwardly extending post engagable with a proximal end of a first flexible retaining strap, said first flexible retaining strap further having a distal locking portion and a jar engaging mid portion, extending between said post engaging proximal end portion and said distal locking portion of said first flexible retaining strap, said distal locking portion engagable in a locking arrangement between at least one further upwardly extending post and an upwardly extending pivotable locking cam post, wherein the jar is retained by said flexible retaining strap in an immobile position when said first flexible retaining strap is wrapped around the jar and said distal locking portion of said first flexible retaining strap is locked in place between said further upwardly extending post and said rotatable upwardly extending cam post.

2. The jar holder as in claim 1 wherein said at least one upwardly extending post and said further upwardly extending post comprise a pair of fixed posts joined by at least one further flexible strap extending therebetween, wherein the jar is retained between said first flexible retaining strap and said further flexible strap.

3. The jar holder as in claim 2 wherein said at least one further flexible strap includes a strip extending between said pair of fixed posts.

4. The jar holder as in claim 3 wherein said at least one first further flexible strap, includes an upper strip extending between said pair of fixed posts and a lower strip extending below said upper strip and extending between said pair of fixed posts.

5. The jar holder as in claim 1 wherein said upwardly extending pivotable locking cam post is adjacent to said at least one further upwardly extending post, wherein said upwardly extending pivotable locking cam post alternately locks and releases said first flexible retaining strap between said at least one further upwardly extending post and said upwardly extending pivotable locking cam post.

6. The jar holder as in claim 1, wherein said first flexible retaining strap includes a pair of further flexible jar engaging portions, including a lower flexible jar engaging portion extending below an upper jar engaging portion of said first flexible retaining strap, said upper jar engaging portion extending above said lower jar engaging portion of said first flexible retaining strap.

7. The jar holder as in claim 1 wherein said flexible retaining strap is wrapped around the jar in a tight fitting relationship, retaining said jar in said immobile position upon said base.

8. The jar holder as in claim 1 wherein said base includes a downwardly extending shoulder providing a right angle corner between an underside of said base and said downwardly extending shoulder.

9. The jar holder as in claim 8 wherein said base includes at least one friction inducing pad between said base and a surface upon which said base is mounted.

10. The jar holder as in claim 9 wherein said base includes a locking member locking said base to said surface.

11. The jar holder as in claim 10 wherein said locking member is a releasable, lockable suction cup.

12. A jar holder comprising a flexible retaining strap extending around a circumferential exterior of a jar having a cap to be loosened, said flexible retaining strap having a fixed proximal end and a lockable distal end insertable between at least one fixed member and a rotatable locking cam member, said locking cam member urged against said flexible retaining strap in a locking relationship when said flexible retaining strap is moved between said fixed member and said locking cam member, a base, the jar supported by said base, said base having said at least one fixed member thereon, said at least one fixed member including a pair of fixed upwardly extending posts, said fixed upwardly extending posts having at least one further retaining strip extending therebetween;

said flexible retaining member extending around the jar from at least one of said fixed posts to between at least one of said fixed posts and said locking cam member, said locking cam member including a rotatable upwardly extending locking cam post movable from an open position to a locked closed position when a distal end of said flexible retaining strap is pulled therebetween.

* * * * *